US006610172B1

(12) United States Patent
Lund et al.

(10) Patent No.: US 6,610,172 B1
(45) Date of Patent: Aug. 26, 2003

(54) PROCESS FOR TREATING PULP WITH LACCASE AND A MEDIATOR TO INCREASE PAPER WET STRENGTH

(75) Inventors: Martin Lund, København (DK); Claus Felby, Herlev (DK)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 09/532,065

(22) Filed: Mar. 21, 2000

Related U.S. Application Data

(60) Provisional application No. 60/133,894, filed on May 12, 1999.

(30) Foreign Application Priority Data

May 6, 1999 (DK) ..... 1999 00611

(51) Int. Cl.[7] ..... D21H 21/20; D21H 25/02

(52) U.S. Cl. ..... 162/72; 162/190; 435/277; 435/278

(58) Field of Search ..... 435/277, 278; 162/72, 190; 264/505; 169/9

(56) References Cited

U.S. PATENT DOCUMENTS

| | | | | |
|---|---|---|---|---|
| 4,687,745 A | | 8/1987 | Farrell | 162/72 |
| 5,619,806 A | * | 4/1997 | Warren | 162/290 |
| 5,691,193 A | * | 11/1997 | Paice et al. | 162/9 |
| 6,103,059 A | * | 8/2000 | Call | 162/72 |

FOREIGN PATENT DOCUMENTS

| | | | | |
|---|---|---|---|---|
| EP | 0 219 643 | | 4/1987 | |
| EP | 0 429 422 | | 5/1991 | |
| WO | WO 93/23606 | | 11/1993 | |
| WO | WO 94/12620 | | 6/1994 | |
| WO | WO 95/01426 | | 1/1995 | |
| WO | WO 95/09946 | | 4/1995 | 162/65 |
| WO | 95/09946 | * | 4/1995 | 162/65 |
| WO | WO 96/10079 | | 4/1996 | |
| WO | WO 96/12845 | | 5/1996 | |
| WO | WO 96/12846 | | 5/1996 | |
| WO | WO 97/41215 | | 11/1997 | |

OTHER PUBLICATIONS

Stenberg, Svensk Papperstidning nr 2, pp. 49–54 (1978).

* cited by examiner

*Primary Examiner*—Steve Alvo
(74) *Attorney, Agent, or Firm*—Elias Lambiris; Jason Garbell

(57) ABSTRACT

A process for producing paper materials having improved wet strength. This process involves (a) preparing a suspension of unbleached or semi-bleached chemical or semi-chemical pulp or pulp from recycled fibers; (b) treating the pulp with a phenol-oxidizing enzyme and a mediator; and (c) de-watering the treated pulp in a paper making machine to remove process water and produce the paper material. Preferably, the paper material is heated after the completion of step (c). By the process of the invention, the wet strength of paper materials can be improved without using wet strength resins which makes the product more easily re-used. Further disclosed is a process for producing corrugated paperboard or corrugated containers.

10 Claims, 2 Drawing Sheets

PROCESS FOR TREATING PULP WITH LACCASE AND A MEDIATOR TO INCREASE PAPER WET STRENGTH

CROSS-REFERENCE TO RELATED APPLICATIONS

This application claims priority under 35 U.S.C. 119 of U.S. provisional application No. 60/133,894 filed May 12, 1999 and Danish application no. PA 1999 00611 filed May 6, 1999, the contents of which are fully incorporated herein by reference.

BACKGROUND OF THE INVENTION

1. Field of the Invention

The present invention relates to a process for producing paper materials such as paper, linerboard or corrugated linerboard from unbleached and semi-bleached chemical or semichemical pulp or pulp from recycled fibers.

2. Description of the Related Art

Linerboard and corrugated medium, used for making corrugated paperboard and corrugated cartons, are commonly made from a suspension of unbleached chemical or semichemical pulp or pulp from recycled fibers.

Typically, the pulp is treated in a screening process, refined, then mixed with paper making additives in the stock preparation section before the pulp suspension is de-watered on the paper/board machine, and the drained water (so-called white water) is recycled back into the process for dilution of the screened stock.

The white water will normally contain high amounts of wood fibers/fines, sterol esters, resin acids, lignans, and lignin fragments typically in concentrations of 100–500 ppm or higher; all of this material will have phenolic or phenol-like groups.

Strength, particularly compression strength, is an important mechanical property of the unbleached board grades used to make corrugated boxes: linerboard and corrugated linerboards. Due to new governmental rules in some countries giving an alternative specification based on combined board edge crush and since combined edge crush can be tied directly to the compression strength of the board's components it is now possible to sell board on a performance per square meter basis rather than only by weight.

Clearly, the wet strength of unbleached board grades used to make corrugated boxes is also of importance.

EP 429,422 discloses reduction of energy consumption in the refining stages by use of laccase during pulp preparation between the first and second refining stage; the document indicates that some increase of paper strength is also obtained.

WO 93/23606 (EP 641 403) discloses a process for treating a mechanical pulp with a phenol-oxidizing enzyme system to increase the strength of the produced paper.

WO 95/09946 discloses a process for producing linerboard or corrugated medium having increased strength by treating pulp with a phenol-oxidizing enzyme.

WO 95/07604 discloses a process for producing fiberboard having improved mechanical properties by treating a slurry or suspension of a lignin-containing wood fiber material with a phenol-oxidizing enzyme.

U.S. Pat. No. 4,687,745 discloses a process for enhancing the strength properties and brightness stability of mechanical pulp by treating the pulp with ligninolytic enzymes. The wet strength of paper materials may be enhanced by adding wet strength resins to the pulp. However, these resins will enhance the strength of the paper material in such a way that re-use of the paper material will become difficult.

It is an object of the present invention to provide a process for producing, from unbleached or semi-bleached chemical or semichemical pulp, paper materials such as paper, linerboard or corrugated linerboard having improved wet strength.

SUMMARY OF THE INVENTION

The present inventors have now surprisingly found that the wet strength of paper materials can be increased by treating a pulp suspension with a phenol-oxidizing enzyme system prior to the paper machine. It has also been found that the wet strength can be further improved by a combined enzyme/mediator treatment. The wet strength may be even further improved by additionally applying a heat treatment.

Accordingly, in a first aspect the present invention relates to a process for producing paper materials with improved wet strength, comprising:

(a) preparing a suspension of unbleached or semi-bleached chemical or semichemical pulp or pulp from recycled fibers;

(b) treating the pulp with a phenol oxidizing enzyme and a mediator; and (c) de-watering the treated pulp in a paper making machine to remove process water and produce the paper material.

In a preferred embodiment, the process water from step (c) is recycled, and step (a) comprises dilution of the pulp with the recycled process water. Advantageously, the enzymatic treatment of the pulp and white water suspension will to a large extent polymerize the aromatic materials present in the white water (lignans, resin acids, sterol esters, lignin-like compounds fibers and fines), so that they are retained in the paper sheet, leading to an increased yield and a decreased COD (chemical oxygen demand) load and toxicity of the effluent. This polymerization is also believed to contribute to strengthening of the linerboard or corrugated medium.

In a further preferred embodiment the paper material is heated after the completion of step (c).

In a second aspect the present invention relates to a process for making corrugated paperboard or corrugated boxes using the linerboard and/or corrugated linerboard produced by the process of the invention.

In a third aspect the present invention relates to the use of a phenol-oxidizing enzyme in combination with a mediator to produce a paper material with improved wet strength.

Figure 1:
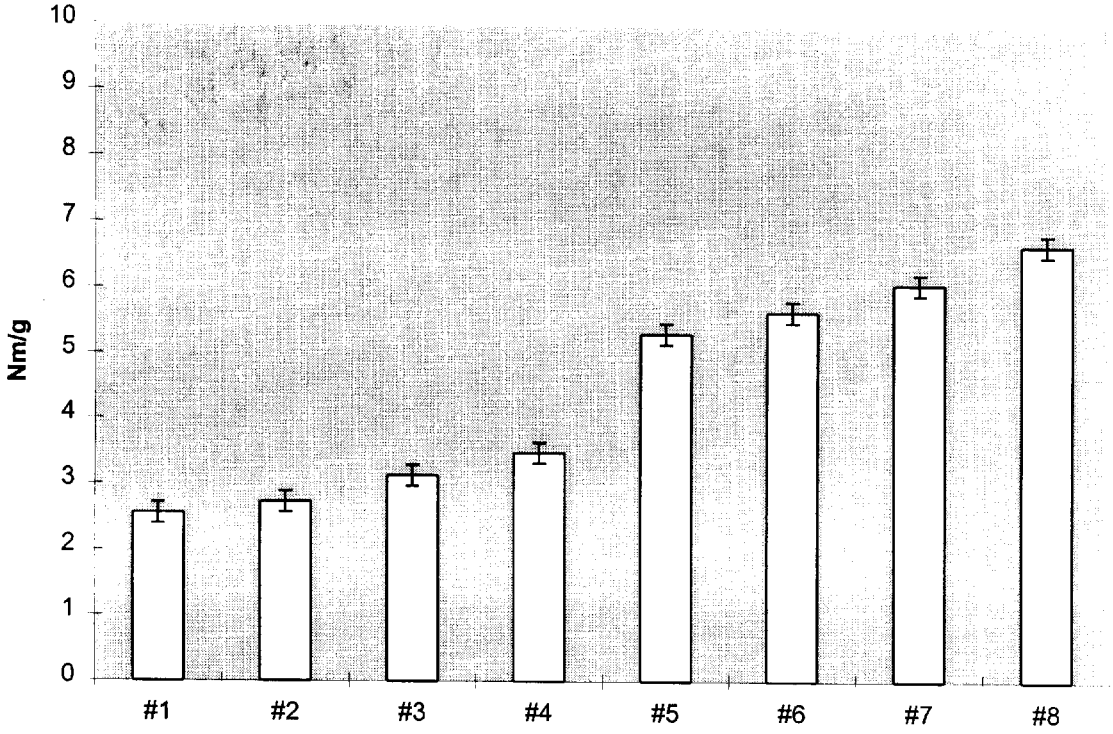
FIG. 1 shows the wet tensile strength of the sheets produced in Example 1. Data is taken from Table 1. Vertical bars indicate the 95% confidence limit.

C: Conventional drying in condition chamber.

H: Heat drying of the wet sheet at 150° C. for 5 min.

L: Treatment of pulp with 10 LACU/g for 1 hr.

M: Addition of 50 mM PPT.

The strength of #1 was below the detection limit of 2.2 Nm/g and was a conservative estimate set to this value in FIG. 2. Vertical bars indicate the 95% confidence limit.

DETAILED DESCRIPTION OF THE INVENTION

In the context of the present invention the term "paper material" refers to products, which can be made out of pulp, such as paper, linerboard, corrugated paperboard, corrugated container or boxes.

The term "improved wet strength" indicates that the wet strength of the paper material is increased/enhanced in comparison to the paper material which has not be treated according to the invention.

Pulp

The pulp to be used in the process of the invention is a suspension of unbleached or semi-bleached chemical or semichemical pulp or pulp from recycled fibers. Unbleached or semi-bleached pulp is characterized by containing lignin, which is used as substrate for the enzyme system. The chemical pulp may be unbleached kraft pulp, and the semi-chemical pulp may be NSSC (neutral sulfite semichemical) pulp. The pulp from recycled fibers may be made from a chemical pulp, such as unbleached kraft pulp. A specific example of recycled fibers made from a chemical pulp includes OCC (old corrugated containers).

The preparation of the pulp suspension may comprise beating or refining of the pulp, depending on the type of pulp.

Phenol Oxidizing Enzyme System

The enzyme system used in the invention consists of a suitable oxidase together with $O_2$ or a suitable peroxidase together with $H_2O_2$. Suitable enzymes are those, which oxidize and polymerize aromatic compounds such as phenols and lignin.

Examples of suitable enzymes are catechol oxidase (EC 1.10.3.1), laccase (EC 1.10.3.2), bilirubin oxidase (EC 1.3.3.5) and peroxidase (EC 1.11.1.7) and haloperoxidases. The peroxidase may be derived from a strain of Coprinus, e.g. *C. cinerius* or *C. macrorhizus*, or of Bacillus, e.g. *B. pumilus*, from soy bean or horse radish. It may be preferable to use two different phenol oxidizing enzymes together.

Suitable laccases may, for example, be derived from a strain of Polyporus sp., in particular a strain of *Polyporus pinsitus* (also called *Trametes villosa*) or *Polyporus versicolor*, or a strain of Myceliophthora sp., e.g. *M. thermophila* or a strain of Rhizoctonia sp., in particular a strain of *Rhizoctonia praticola* or *Rhizoctonia solani*, or a strain of Scytalidium sp., in particular *S. thermophilium*, or a strain of Pyricularia sp., in particular *Pyricularia oryzae*, or a strain of Coprinus sp., such as a *C. cinereus*.

The laccase may also be derived from a fungus such as Collybia, Fomes, Lentinus, Pleurotus, Aspergillus, Neurospora, Podospora, Phlebia, e.g. *P. radiata* (WO 92/01046), Coriolus sp., e.g. *C. hirsitus* (JP 2-238885), or Botrytis.

In a preferred embodiment of the invention the laccase is derived from a strain of Polyporus sp., especially the *Polyporus pinsitus* laccase (in short: PpL).

The amount of peroxidase should generally be in the range 10–10,000 PODU per g of dry substance (PODU unit of peroxidase activity defined below). The amount of laccase should generally be in the range 0.001–1000 units per g of dry substance (unit of laccase activity defined below).

Molecular oxygen from the atmosphere will usually be present in sufficient quantity. Thus, contrary to prior art bleaching processes (including laccase and mediator) where a high oxygen pressure is necessary, this will usually not be necessary for the purposes described herein. Therefore, the reaction may conveniently be carried out in an open rector, i.e. at atmospheric pressure.

A suitable amount of $H_2O_2$ will usually be in the range 0.01–10 mM, particularly 1–10 mM.

Mediator

According to the invention the phenol-oxidizing enzyme is used in combination with a suitable redox mediator. A so-called "redox mediator" is sometimes in literature referred to as "an enhancing agent". In the present context the term "mediator" will be used.

A "mediator" is an agent capable of enhancing the activity of phenol-oxidizing enzymes.

The mediator may be a phenolic mediator or a non-phenolic mediator. Which mediator is preferred depends on the purpose.

Examples of mediators capable of enhancing the activity of phenol-oxidizing enzymes include the compounds described in WO 95/01426, which is hereby incorporated by reference, and described by formula I:

(I)

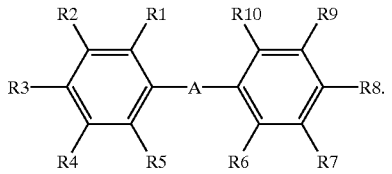

The definition of the R1 to R10 and A groups can be found in WO 95/010426 (see pp. 9 to 11).

Specifically contemplated compounds within the above formula I include the following: 2,2'-azino-bis(3-ethylbenzothiazoline-6-sulfonate (ABTS); 6-hydroxy-2-naphtoic acid; 7-methoxy-2-naphtol; 7-amino-2-naphthalene sulfonic acid; 5-amino-2-naphthalene sulfonic acid; 1,5-diaminonaphthalene; 7-hydroxy-1,2-naphthimidazole; 10-methylphenothiazine; 10-phenothiazine-propionic acid (PPT); N-hydroxysuccinimide-1O-phenothiazine-propionate; benzidine; 3,3'-dimethylbenzidine; 3,3'-dimethoxybenzidine; 3,3',5,5'-tetramethylbenzidine; 4'-hydroxy-4-biphenylcarboxylic acid; 4-amino-4'-methoxystilbene; 4,4'-diaminostilbene-2,2'-disulfonic acid; 4,4'-diaminodiphenylamine; 2,7-diaminofluorene; 4,4'-dihydroxy-biphenylene; triphenylamine; 10-ethyl-4-phenothiazinecarboxylic acid; 10-ethylphenothiazine; 10-propyl-phenothiazine; 10-isopropylphenothiazine; methyl-10-phenothiazinepropionate; 10-phenylphenothiazine; 10-allyl-phenothiazine; 10-phenoxazinepropionic acid (POP); 10-(3-(4-methyl-i-piperazinyl)propyl)phenothiazine; 10-(2-pyrrolidinoethyl)phenothiazine; 10-methylphenoxazine; imino-stilbene; 2-(p-aminophenyl)-6-methylbenzothiazole-7-sulfonic acid; N-benzylidene-4-biphenylamine; 5-amino-2-naphthalenesul-fonic acid; 7-methoxy-2-naphtol; 4,4'-dihydroxybenzophenone; N-(4-(dimethylamino) benzylidene)-p-anisidine; 3-methyl-2-benzo-thiazolinone (4-(dimethylamino)benzylidene)hydrazone; 2-acethyl-10-methylphenothiazine; 10-(2-hydroxyethyl)phenothiazine; 10-(2-hydroxyethyl)phenoxazine; 10-(3-hydroxypropyl) phenothiazine; 4,4'-dimethoxy-N-methyl-diphenylamine, vanillin azine.

Other mediators contemplated include 4-hydroxybenzoic acid, L-tyrosine, syringate acids, ferulic acid, sinapic acid, chlorogenic acid, caffeic acid and esters thereof.

Still further examples include organic compounds described in WO 96/10079, which is hereby incorporated by reference, and by the following formula II:

(II)

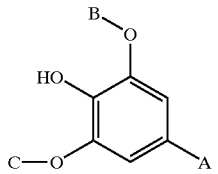

in which A is a group such as —D, —CH═CH—D, —CH═CH—CH═CH—D, —CH═N—D, —N═N—D, or —N═CH—D, in which D is selected from the group consisting of —CO—E, —$SO_2$—E, —N—XY, and —$N^+$—XYZ, in which E may be —H, —OH, —R, or —OR, and X and Y and Z may be identical or different and selected from —H and —R; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

Specific compounds covered by the above formula I are acetosyringone, syringaldehyde, methylsyringate, syringic acid, ethylsyringate, propylsyringate, butylsyringate, hexylsyringate, octylsyringate and ethyl 3-(4-hydroxy-3,5-dimethoxyphenyl).

Other suitable mediators are vanillic acid, NHA, HOBT, PPO and violoric acid.

Process Conditions

The enzyme treatment can be done at conventional consistency, e.g., 0.5–25% (particularly 0.5–10%) dry substance, at temperatures of 20–90° C. and at a pH of 4–10. Furthermore, the enzyme (and mediator) treatment may be carried out at atmospheric pressure.

The enzyme activity when using a laccase is 0.001–1000 LACU per gram of dry substance.

Determination of Peroxidase Activity (PODU)

Peroxidase activity is determined from the oxidation of 2,2'-azinobis(3-ethylbenzothiazoline-6-sulfonate) (ABTS) by hydrogen peroxide. The greenish-blue color produced is photometered at 418 nm. The analytical conditions are 0.88 mM hydrogen peroxide, 1.67 mM ABTS, 0.1 M phosphate buffer, pH 7.0, 30° C., 3 minutes reaction.

1 peroxidase unit (PODU) is the amount of enzyme that catalyzes the conversion of 1 mmol hydrogen peroxide per minute at these conditions.

Determination of Laccase Activity (LACU)

Laccase activity was determined by a similar method without addition of hydrogen peroxide. 1 laccase unit (LACU) is defined as the amount of enzyme which, under standard conditions (pH 5.5, 30° C.), oxidizes 1 mmol syringaldazine per minute.

The invention is further illustrated by the following non-limiting examples.

EXAMPLES

Example 1

A beaten and unbleached kraft pulp kappa 85 obtained from the Obbola mill in Sweden was disintegrated in a laboratory disintegrator and diluted to a consistency of 1%. A water phase was used either tap water or white water from the Obbola mill. pH was adjusted to 5.5±0.1 with 1 M sulphuric acid and this was maintained by further addition of acid. An enzyme dosage of 15 LACU/g dry pulp (laccase derived from *Polyporus pinsitus*) was added and the suspension was stirred for 1 hour.

Isotropic sheets with a specific weight of 150 g/$m^2$ were formed on a semiautomatic papermaker of the Rapid-Konthen type. When comparing the tensile strength of sheets subjected to different treatment it is of crucial importance that the sheets have the same density. Heat drying of a sheet increases its density, and to compensate for this, sheets to be air-dried were pressed to a higher density than sheets to be heat-dried.

A trial was performed comprising the following variables: white water, laccase and heat drying.

In experiments without white water, the pulp was suspended in distilled water. Heat dried sheets were dried in an oven at 170° C. and were stacked with each sheet separated by blotting paper and placed with a weight on top to prevent shrinkage. All blotting papers were replaced after 20, 30 and 40 min. After heat drying all sheets were placed in a condition chamber at 50% RH and 23° C. overnight. Sheets not heat dried were dried conventionally in a condition chamber at 65% RH and 21° C.

Test of tensile strength was performed after SCAN-P67 with 10 test strips. Permanent wet tensile strength was tested after immersion of the test piece into distilled water for 24 hr.

For each of the eight treatments, five sheets were made. The same batch of pulp and white water was used for all treatments, and the entire experiment was carried out on the same day. Data were analyzed with the statistical software package SAS.

Results:

The obtained results are compiled in Table 1 and FIG. 1. From Table 1 it can be seen that the density between the sheets differ somewhat, which should be borne in mind when interpreting the results.

TABLE 1

| | | | Heat drying 170° C. | | | |
|---|---|---|---|---|---|---|
| Exp. No. | White water | 15 LACU/g | Drying 170° C. | Specific weight (g/$m^2$) | Density (kg/$m^3$) | Wet tensile index (kNm/kg) |
| 1 | – | – | – | 154.8 | 710 | 2.56 |
| 2 | + | – | – | 154.7 | 710 | 2.73 |
| 3 | – | + | – | 155.4 | 713 | 3.13 |
| 4 | + | + | – | 166.2 | 717 | 3.48 |
| 5 | – | – | + | 154.8 | 704 | 5.30 |
| 6 | + | – | + | 152.8 | 661 | 5.63 |
| 7 | – | + | + | 153.8 | 660 | 6.04 |
| 8 | + | + | + | 161.6 | 682 | 6.64 |

Result from experiments comprising: white water, PpL laccase and heat drying at 170° C.

The main effects are shown in Table 2 with the corresponding least significant difference (LSD) values.

TABLE 2

Main effect of variables (difference between means of the variables at high and low level). Significance at the 0.05 level is indicated by *** based on a T-test. Least significant differences (LSD) on the 0.05 level written in parentheses. All values are in Nm/g.

| Effect | Wet tensile strength (LSD 0.33) |
|---|---|
| White water | 0.36*** |
| Enzyme (15 LACU/g) | 0.77*** |
| Heat drying at 170° C. | 2.93*** |

The wet tensile strength was significantly affected by all variables. Heat drying had the highest impact on the wet tensile strength with almost 3 Nm/g followed by the laccase treatment with 0.8 Nm/g. The increase in wet tensile strength by adding enzyme to a pulp suspended in white water and where the sheets are heat-dried, is in the order of 20% (compare experiments Nos. 6 and 8).

Example 2

A beaten and unbleached kraft pulp kappa 85 obtained from the Obbola mill in Sweden was disintegrated in a laboratory disintegrator and diluted to a consistency of 1%. pH was kept at 5.5 using a 0.05 M sodium acetate buffer. PpL laccase and a mediator were added and the slurry stirred for 1 hour at room temperature. The enzyme dosage was 10 LACU/g dry pulp in all experiments.

Isotropic handsheets with a specific weight of 150 g/m2 were made of the modified pulp according to SCAN-P:26. In those experiments where the sheets were subjected to a heat treatment this was done to the wet sheets immediately after the second pressing step in a restrained dryer at 150° C. for 5 min, and was then conditioned at 65% RH and 23° C. All other sheets were dried in a conditioning chamber at 65% RH and 21° C. The dry- and wet tensile strength were determined according to SCAN-P:38. Before measuring the wet tensile strength, the test strip was immersed in distilled water for 1 or 24 hours.

Results:

A standard method for testing the strength of a chemical pulp was used, where the sheets were dried in a condition chamber at 65% RH and 21° C. The obtained results are compiled in FIG. 2.

Figure 2:
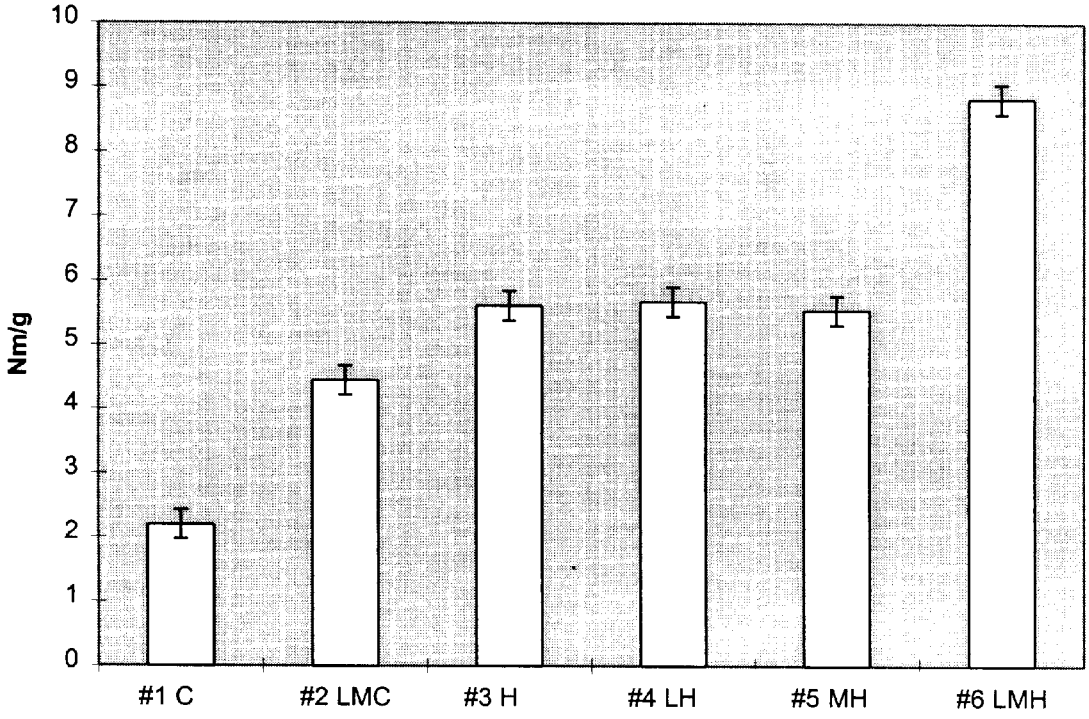
FIG. 2 shows the wet strength after immersion into distilled water for 24 hours of paper subjected to different treatments as described in Example 2. The following abbreviations have been used.

As can be seen from FIG. 2, the laccase mediator (PPT) treatment gives a significant increase in the wet tensile strength of the linerboard, both when the paper is subjected to heat treatment (experiments Nos. 3 and 6) and when not subjected to heat treatment (Nos. 1 and 2). Heat treatment of paper is known to confer wet strength, possibly through generation of covalent bonds between cellulose chains, but the treatment of the pulp with laccase and PPT increased this effect by about 50%, cf. FIG. 2.

Addition of PPT or laccase alone (experiments Nos.4 and 5), did not change the wet tensile strength of the heat treated paper. This was also observed when the paper was not heat-treated (not shown).

Table 3 shows the wet tensile strength of paper sheets made from kraft pulp oxidized with laccase and different mediators prior to sheet formation. Although the error within an experiment was low, the day-to-day variation was rather high, and therefore the effect of a given mediator should be evaluated by comparing all values to the control sheet within the same experiment. By doing so, it becomes evident that PPT, followed by ABTS, yields the highest wet strength.

TABLE 3

Wet strength of isotropic handsheets made of a kraft pulp oxidized with PpL (10 LACU/g) and a mediator. The wet tensile strength was tested after immersion into distilled water for 1 hour. In some of the experiments the control sheet did not have a measurable wet strength, and therefore this was set to maximum <2.2, which is the lowest detection limit

| Mediator | Concentration (mM) | Wet tensile index (kNm/kg) |
|---|---|---|
| None (control) | 0 | 2.7 |
| Vanillic acid | 60 | 4.1 |
| Vanillic acid | 600 | 4.3 |
| 4,4'-dihydroxy-diphenylmethane | 250 | 4.7 |
| None (control) | 0 | 3.1 |
| TEMPO | 40 | 5.0 |
| PPT | 40 | |
| Methyl syringate | 40 | 5.5 |
| NHA | 40 | 4.9 |
| None (control) | 0 | <2.2 |
| PPO | 40 | 3.7 |
| ABTS | 40 | 4.7 |
| Promethiazine | 40 | 2.7 |
| 3,5-dimethoxy-4-hydroxy-acetophenon | 40 | 3.1 |
| None (control) | 0 | <2.2 |
| PPT | 40 | 4.4 |
| HOBT | 40 | 2.3 |
| 10-methylpheno-thiazine | 40 | 3.0 |
| Violoric acid | 40 | 2.3 |

Under the right conditions, heat treatment of paper is known to increase the wet strength up to a value of 30% of the dry strength (Stenberg, E. L., Svensk Papperstidning 8:49–54, 1978).

In this study it was tested if the effects of the laccase/mediator treatment shown in Table 3 could be further increased by combining this with a heat treatment of the paper. It was chosen to apply the heat treatment to the paper as soon as possible after the oxidation with laccase and PPT, and was therefore given after pressing the wet sheet. From the data depicted in FIG. 2, it can be seen that the heat treatment itself more than doubles the wet strength. Adding laccase alone or PPT to the pulp before the heat treatment does not effect the wet strength, but using a combination of laccase and PPT gives an increase of 50% in wet strength of the heat-treated paper. It should be noted that all wet tensile strength in this part of the report was tested after 24 hours immersion. When a sheet made from pulp oxidized with laccase and PPT and then heat dried, was immersed for only 1 hour a wet tensile strength of 10 Nm/g could be measured (not shown).

What is claimed is:

1. A process for producing paper materials with improved wet strength, comprising:

(a) preparing a suspension of unbleached or semi-bleached chemical or semichemical pulp or pulp from recycled fibres;

(b) treating the pulp with a laccase and a mediator;

(c) de-watering the treated pulp in a paper making machine to remove process water and produce a paper sheet, and;

(d) heat-drying the paper sheet at a temperature of 150° C. or above to produce a heat treated paper of increased wet strength.

2. The process of claim 1, wherein the mediator is 10-phenothia-zine-propionic acid (PPT) or 2,2'-azino-bis(3-ethylbenzo-thiazoline-6-sulfonate (ABTS).

3. The process of claim 1, wherein at least a part of the process water from step (c) is recycled, and step (a) comprises dilution of the pulp with the recycled process water.

4. The process of claim 1, wherein the laccase is derived from *Polyporus pinsitus*.

5. The process of claim 1, wherein the laccase is present in an amount of 10–10,000 PODU per gram of dry matter or 0.001–1000 LACU per gram of dry matter.

6. The process of claim 1, wherein the enzyme treatment is performed on a pulp having a consistency of 0.5–25%, a pH of 4–10, and a temperature of 20–90° C.

7. The process of claim 1, wherein the laccase treatment is carried out at atmospheric pressure.

8. The process of claim 1, wherein the pulp is unbleached or semi-bleached kraft pulp, neutral sulfite semichemical pulp, or recycled pulp from old corrugated containers.

9. The process of claim 8, wherein the recycled pulp from old corrugated containers is an unbleached kraft pulp.

10. A process for producing corrugated paperboard or corrugated containers, comprising producing linerboard and/or corrugated linerboard by the process of claim 1, and combining linerboard and corrugated linerboard to produce the corrugated paperboard or container.

* * * * *